US007661548B2

(12) United States Patent
Shmagin

(10) Patent No.: US 7,661,548 B2
(45) Date of Patent: Feb. 16, 2010

(54) HOT-FILL CONTAINER WITH IMPROVED TOP-LOAD PERFORMANCE

(75) Inventor: Dmitriy Shmagin, Palatine, IL (US)

(73) Assignee: The Quaker Oats Company, Chicago, IL (US)

( * ) Notice: Subject to any disclaimer, the term of this patent is extended or adjusted under 35 U.S.C. 154(b) by 705 days.

(21) Appl. No.: 11/338,970

(22) Filed: Jan. 25, 2006

(65) Prior Publication Data

US 2007/0170143 A1 Jul. 26, 2007

(51) Int. Cl.
*B65D 90/02* (2006.01)
*B65D 90/22* (2006.01)

(52) U.S. Cl. ..... 215/381; 215/383

(58) Field of Classification Search ..... 215/381–384
See application file for complete search history.

(56) References Cited

U.S. PATENT DOCUMENTS

| | | | | |
|---|---|---|---|---|
| 4,805,788 | A | 2/1989 | Akiho | |
| D379,153 | S | 5/1997 | Richardson | |
| D379,154 | S | 5/1997 | Cox | |
| D385,796 | S | 11/1997 | Richardson | |
| D386,088 | S | 11/1997 | Satoh | |
| 5,732,838 | A | 3/1998 | Young | |
| D398,855 | S | 9/1998 | Ito | |
| 6,016,932 | A * | 1/2000 | Gaydosh et al. | 215/382 |
| D424,948 | S | 5/2000 | Ullmo | |
| D427,518 | S | 7/2000 | Steward | |
| D432,019 | S | 10/2000 | Steward | |
| D447,061 | S | 8/2001 | Peek | |
| 6,398,052 | B1 * | 6/2002 | Cheng et al. | 215/384 |
| 6,467,639 | B2 * | 10/2002 | Mooney | 215/384 |
| D466,023 | S | 11/2002 | Eickmeier | |
| 6,830,158 | B2 * | 12/2004 | Yourist | 215/381 |
| 7,025,219 | B2 * | 4/2006 | Heisner et al. | 215/384 |
| D528,427 | S * | 9/2006 | Sasaki et al. | D9/541 |
| 7,455,189 | B2 * | 11/2008 | Lane et al. | 215/381 |
| 2003/0075521 | A1 * | 4/2003 | Miura | 215/384 |
| 2003/0168425 | A1 * | 9/2003 | Yourist | 215/381 |
| 2006/0054587 | A1 * | 3/2006 | Oguchi et al. | 215/381 |
| 2006/0175284 | A1 * | 8/2006 | Noll et al. | 215/382 |
| 2006/0289378 | A1 * | 12/2006 | Zhang | 215/381 |
| 2007/0045222 | A1 * | 3/2007 | Denner et al. | 215/382 |

FOREIGN PATENT DOCUMENTS

| | | |
|---|---|---|
| JP | 07010147 | 1/1995 |
| JP | 08011889 | 1/1996 |
| JP | 08143019 | 6/1996 |
| WO | 03/076279 | 9/2003 |
| WO | 2005/115850 | 12/2005 |

* cited by examiner

*Primary Examiner*—Anthony Stashick
*Assistant Examiner*—Niki M Eloshway
(74) *Attorney, Agent, or Firm*—Banner & Witcoff, Ltd.

(57) ABSTRACT

A plastic container comprising a base that is attached to a body section which is connected to a dome section by a circumferential ring is provided. The dome section comprises a plurality of circumferentially spaced hydrostatic pressure absorption panels each located between vertically extending, circumferentially spaced ribs that absorbs at least a substantial portion of the external downwardly directed vertical forces exerted on the container and restores the container to its original shape. In addition, a method of absorbing a downward, vertical top-load is provided.

22 Claims, 6 Drawing Sheets

HOT-FILL CONTAINER WITH IMPROVED TOP-LOAD PERFORMANCE

FIELD OF THE INVENTION

The present invention relates to plastic containers. More particularly, the present invention relates to a plastic container construction featuring a dome design that can absorb at least a substantial portion of an external downwardly directed vertical force that may be exerted on the bottle.

BACKGROUND OF THE INVENTION

Plastic bottles are popular for manufacturers and bottlers of hot-fill and cold-fill beverages. Despite numerous advantages over traditional containers, plastic containers present many problems that traditional containers did not have. For example, plastic containers lack the structural rigidity that traditional containers like glass bottles have. As a result, plastic containers are significantly more susceptible to collapsing or losing their shape when subjected to external downward vertical forces. These downward forces, commonly known as top-load forces, are typically present on the plastic bottles when filled and capped, when stacked and stored in trays or otherwise stacked on top of each other such as during shipment or when on display at a retail store. Those downward forces at times can increase dramatically as a result of transient shock forces that may occur, for example, during transport. During the hot-fill process, transportation, storage, and display of product in plastic bottles, the bottles are constantly subjected to top-load forces. It is not uncommon for bottles under these conditions to fail.

A need exists for a plastic container design that is capable of absorbing such top-load forces exerted on the bottle without causing the container to fail and that restores the container to its original shape when the force is removed.

SUMMARY OF THE INVENTION

In accordance with one aspect of the present invention, a plastic container is provided featuring a dome design that absorbs a substantial portion of an external downward force exerted on the container and permits the bottle to be restored to its original shape and geometry. Such downward vertical forces typically are exerted on a plastic bottle during filling, storage in trays, during transportation, and retail display. The container comprises a base attached to a body section and a dome section attached to the body section, typically by a circumferential ring. In addition, the container further comprises a finish having an opening which can be adapted to receive a closing member.

The dome section of the container comprises a plurality of hydrostatic pressure absorption panels. The hydrostatic pressure absorption panels are circumferentially spaced panels each located between vertically extending, circumferentially spaced ribs. Typically, the number of hydrostatic pressure absorption panels is from about 2 to about 10 panels and preferably from about 4 to about 8 panels. When the bottle is subjected to a sufficient downwardly directed vertical force, the hydrostatic pressure absorption panels move outwardly to absorb at least a substantial portion of the force. Typically, the substantial portion of the force that is absorbed by the hydrostatic pressure absorption panels will be about 20% or more of the downwardly directed force. The design in accordance with the invention allows the bottle to typically withstand about 80% greater downwardly directed force compared to a similar bottle without the hydrostatic pressure absorption panels and the circumferential ring. Surprisingly, it was discovered that the design in accordance with the invention allows the bottle to typically withstand about 200% greater downwardly directed force compared to a bottle having a similar mass, geometry, and volume, but without featuring the hydrostatic pressure absorption panels and the circumferential ring. Preferably the hydrostatic pressure absorption panels have a particular shape and geometry as hereafter disclosed.

In one embodiment of the present invention, the plastic container is intended for hot-fill beverage applications and incorporates a plurality of vacuum flex panels in the body section of the container making the plastic container suitable for such hot-fill applications. The vacuum flex panels are circumferentially spaced in the body section of the plastic container. Typically, the body section incorporates from about 2 to about 10 vacuum flex panels and preferably from about 4 to about 6 vacuum flex panels.

In another embodiment of the present invention, the plastic container is suitable for cold-fill beverage applications, eliminating the need for vacuum flex panels.

In accordance with another aspect of the present invention, a method of absorbing a downward vertical force (also known as a top-load) is provided. The method comprises providing a plastic container as previously described and exerting an external downwardly directed vertical force (a top-load force) on the container causing the hydrostatic pressure absorption panels to move outwardly to absorb at least a substantial portion of the positive, internal pressure in the container resulting from the application of the external downwardly directed vertical force.

In one embodiment of the present invention, the external downward vertical force creates a vertical deformation that is substantially offset by the circumferential ring.

In another embodiment of the present invention, the container has an original shape and geometry prior to the external downward vertical force acting on it; and wherein the container is relieved from the external downward vertical force and is substantially restored to its original shape and geometry.

DETAILED DESCRIPTION OF THE INVENTION

In one aspect of the present invention, a plastic container is provided featuring a dome design that substantially absorbs the external downward force exerted on the container and substantially restores the bottle to its original shape and geometry.

Figure 1:
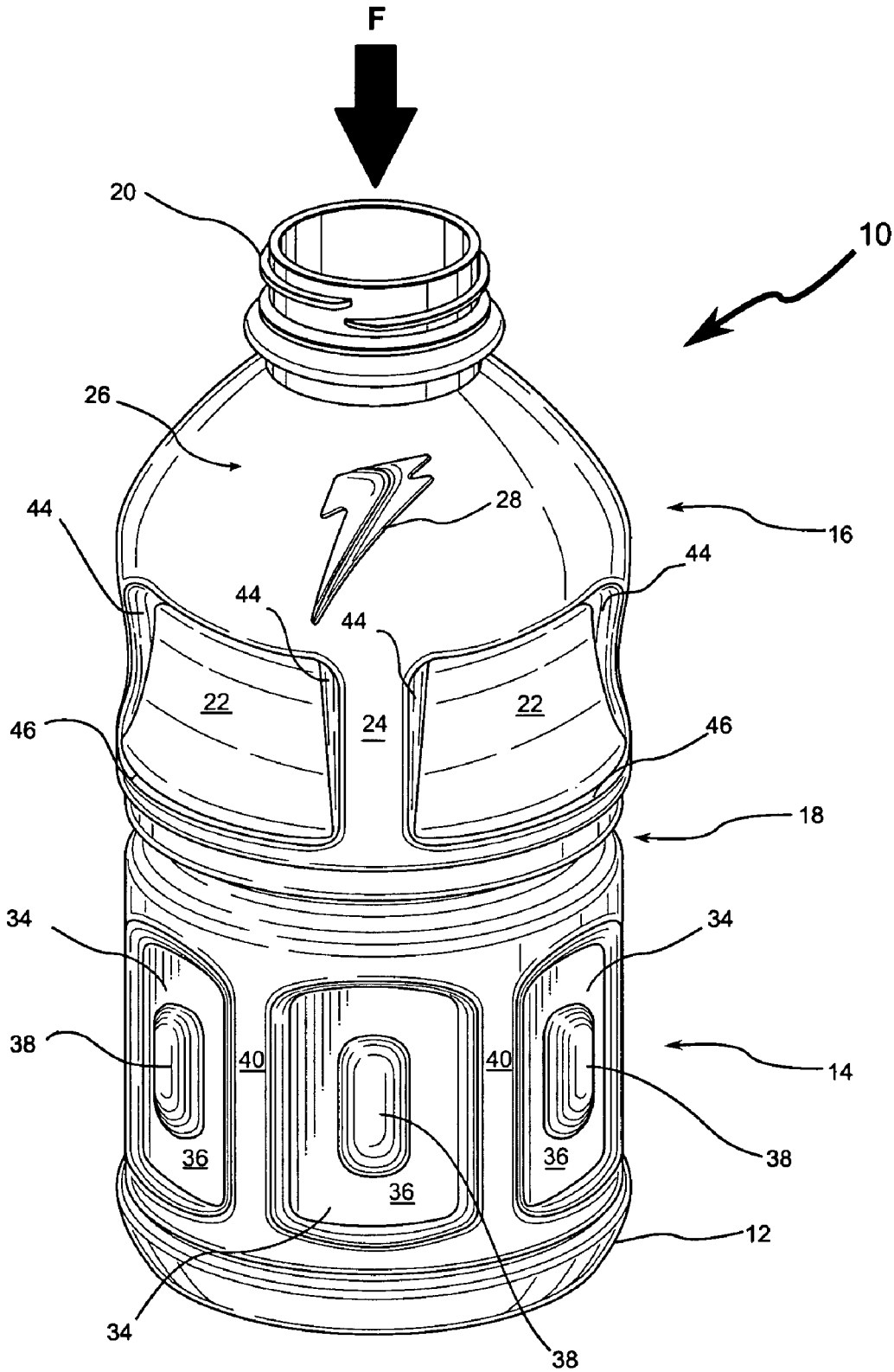
FIG. 1 is a perspective view of a container in accordance with the present invention.
Figure 2:
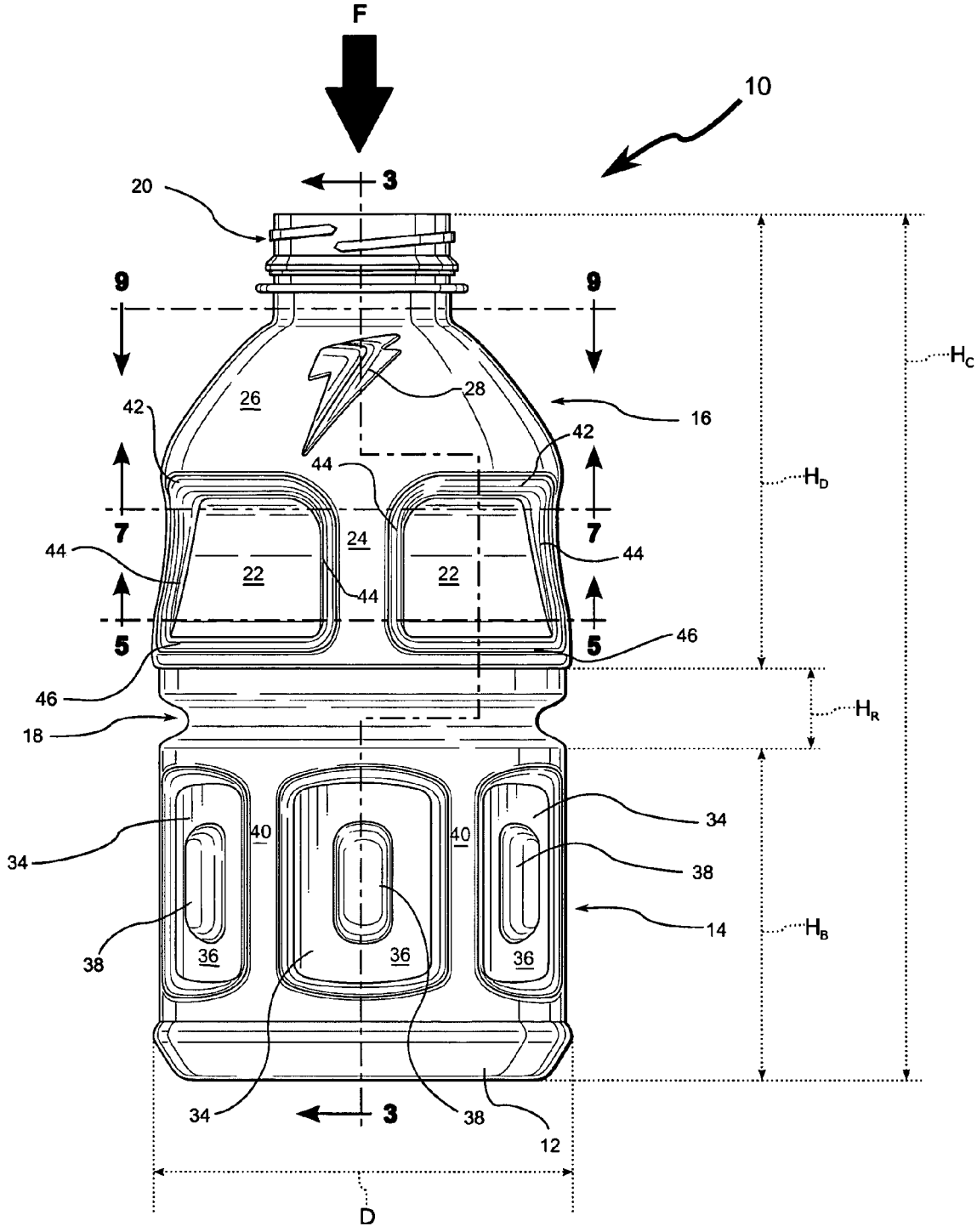
FIG. 2 is a front elevation view of the container of FIG. 1.
Figure 3:
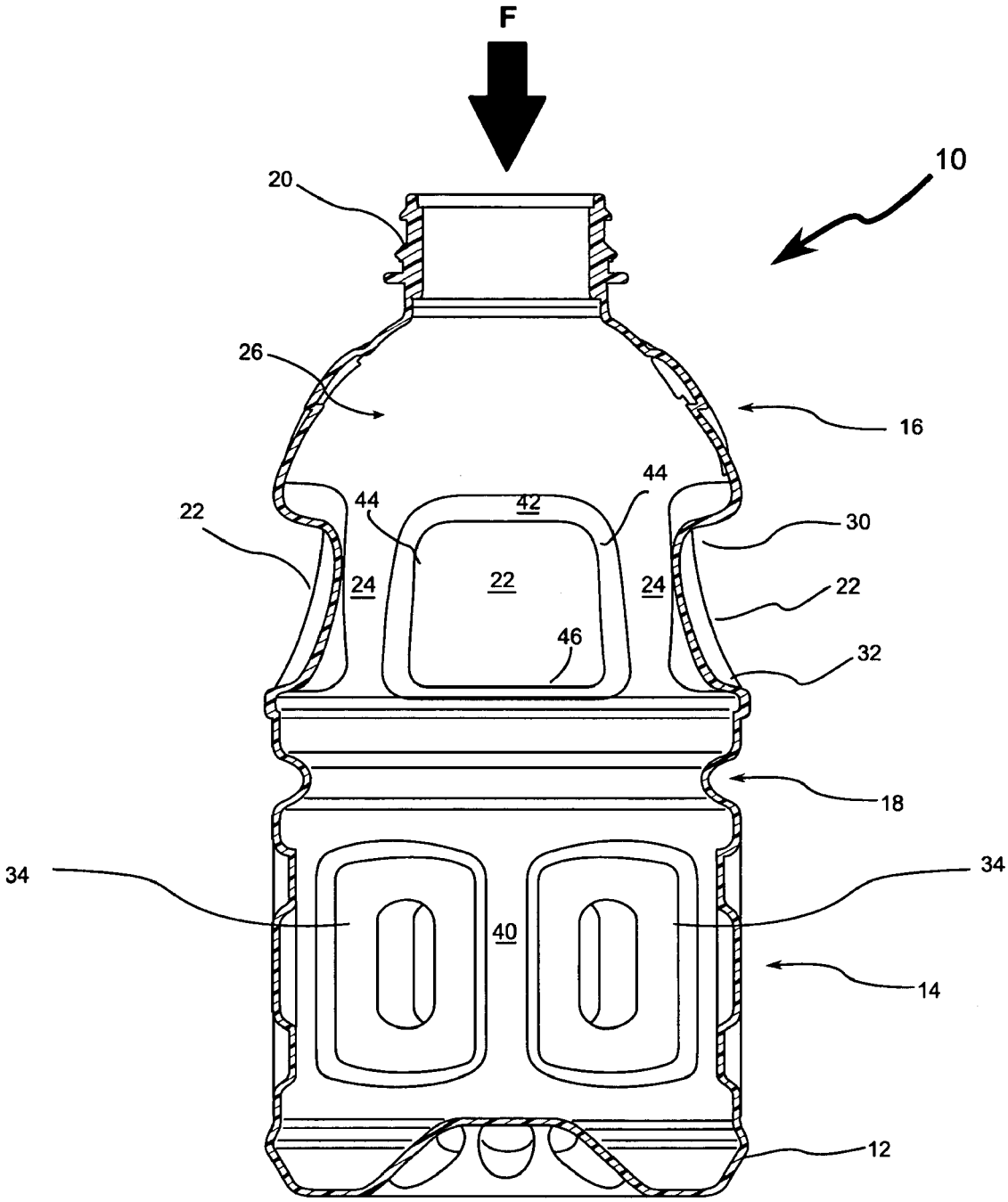
FIG. 3 is a cross sectional view along line 3-3 of FIG. 2.

Referring to the figures generally and in particular to FIGS. 1 through 3, there is illustrated a plastic container 10 in accordance with the present invention. Plastic container 10 is suitable for the hot-filling. of beverages and is generally composed of a base 12, a body section 14, a dome section 16, a circumferential ring 18, and a finish 20.

Base 12 can include any structural design suitable for hot-fill applications known in the art. In particular, base 12 includes a support heel (not shown) which is substantially round. In addition, the support heel has a concave central wall which can include a plurality of ribs that extend outwardly from the center. It is especially preferable that the ribs have a rounded edge and form a symmetric array.

Body section 14 is characterized in that it is generally cylindrical. In one embodiment of the present invention shown in FIGS. 1 through 3, body section 14 comprises a plurality of circumferentially spaced vacuum flex panels 34 and a plurality of vertically extending, circumferentially spaced ribs 40. Each vacuum flex panel 34 is located between ribs 40.

Vacuum flex panels 34 are well known in the art and come in many sizes and geometries. It will be apparent to those skilled in the art that the number of vacuum flex panels is sufficient to relieve the negative, internal pressure that results as the contents of the container cool down after the hot-fill process. In particular, vacuum flex panel 34 has a relatively flat surface 36 and a generally convex portion 38. Typically, body section 14 incorporates from about 2 to about 10 vacuum flex panels, preferably from about 4 to about 6 vacuum flex panels.

Figure 4:
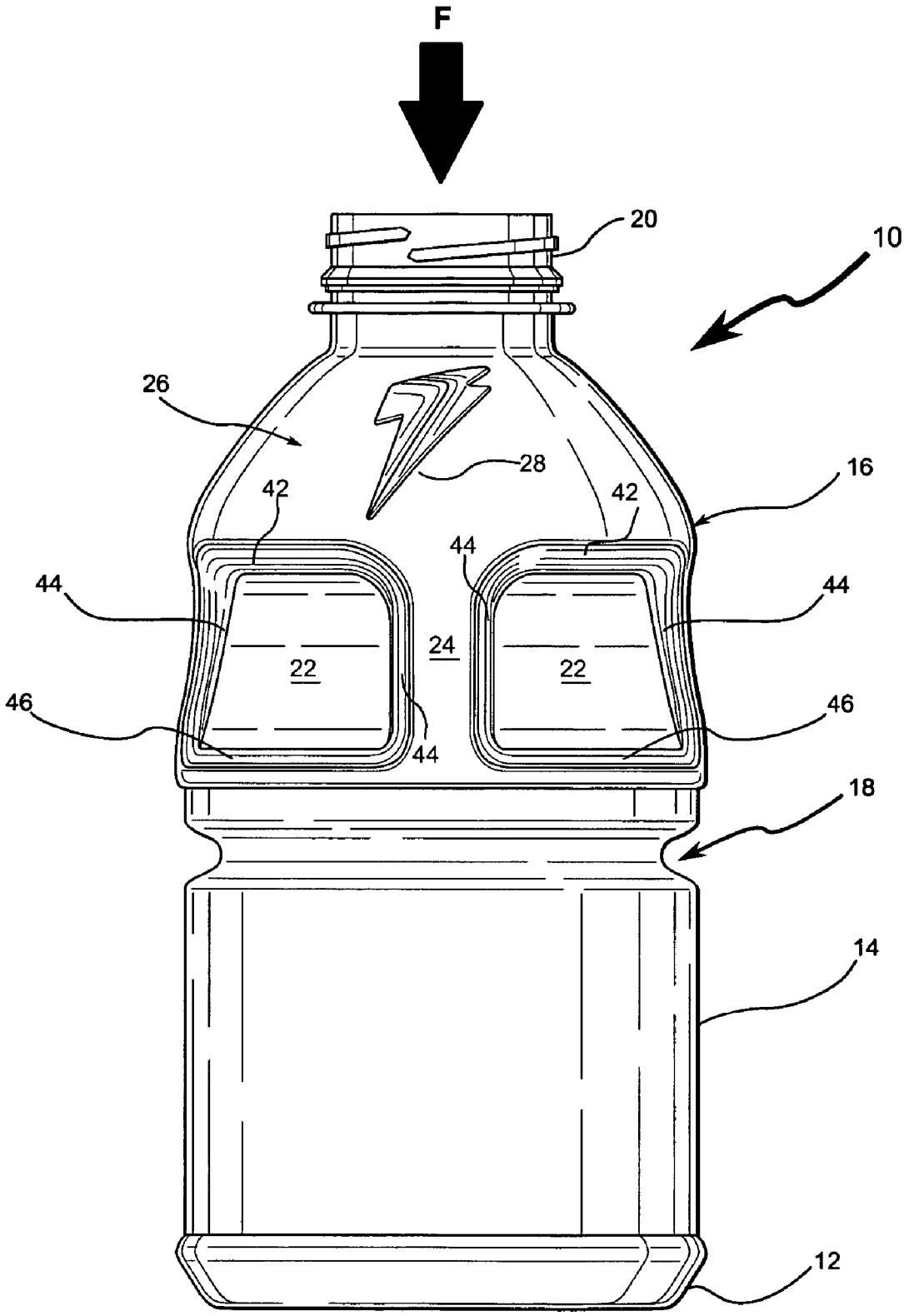
FIG. 4 is a front view of an alternate embodiment of the present invention.

In another embodiment of the present invention shown in FIG. 4, a container 10 suitable for cold-fill applications is illustrated. Body section 14 has no vacuum flex panels and can be generally a smooth and uniform surface. However, those skilled in the art will appreciate that body section 14 can instead incorporate other desirable features like logos, grippable means, and other features known in the art.

Dome section 16 comprises a plurality of circumferentially spaced hydrostatic pressure absorption panels 22 and a plurality of vertically extending, circumferentially spaced ribs 24. Each hydrostatic pressure absorption panel 22 is located between ribs 24. In addition and particularly as shown in FIGS. 1, 2, and 4, dome section 16 can further comprise a logo 28 or a plurality of logos (not shown) located in an area 26.

Figure 8:
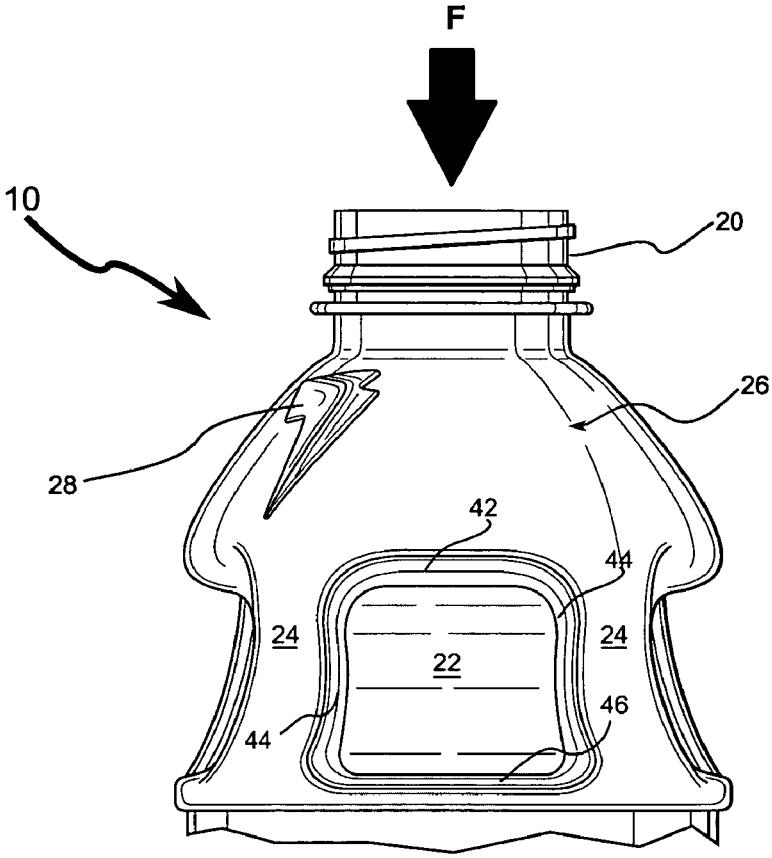
FIG. 8 is a fragmentary front elevation view illustrating the top portion of the container of FIG. 1.

Hydrostatic pressure absorption panels 22 can be generally of any geometric shape such as polygons, ellipses, circles, and other shapes known to those skilled in the art. In one embodiment of the present invention, the shape is a quadrilateral. More particularly, FIGS. 3 and 8 depict hydrostatic pressure absorption panels 22 in the shape of a trapezoid. In addition, hydrostatic pressure absorption panels 22 are generally concentric with respect to the generally circular shape of container 10. As shown in FIG. 3, hydrostatic pressure absorption panels 22 have an inward upper indentation 30 and an inward lower indentation 32. At lower indentation 32 the amount of inward indentation is at its minimum. Moving in an upward direction, the amount of inward indentation increases gradually until it reaches upper indentation 30 which corresponds to the maximum amount of inward indentation. In particular, comparing FIG. 5 which is a cross sectional view along line 5-5 to FIG. 6 which is a cross sectional view along line 7-7, it becomes apparent that hydrostatic pressure absorption panels 22 indent inward. Additionally, as a result of the inward indentation of hydrostatic pressure absorption panels 22, transition elements are created. An upper transition 42 extends outwardly from hydrostatic pressure absorption panels 22. A lower transition 46 extends outwardly from hydrostatic pressure absorption panels 22. A sideways transition 44 extends outwardly from hydrostatic pressure absorption panels 22 to rib 24 on a lateral side of hydrostatic pressure absorption panels 22.

Figure 5:
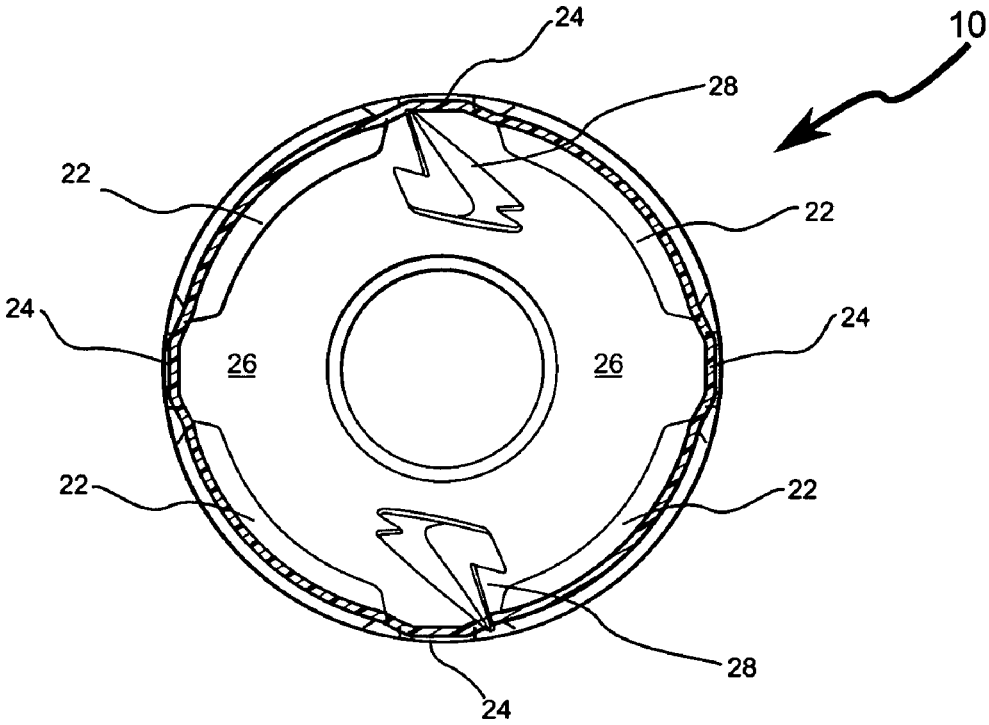
FIG. 5 is a cross sectional view along line 5-5 of FIG. 2.
Figure 6:
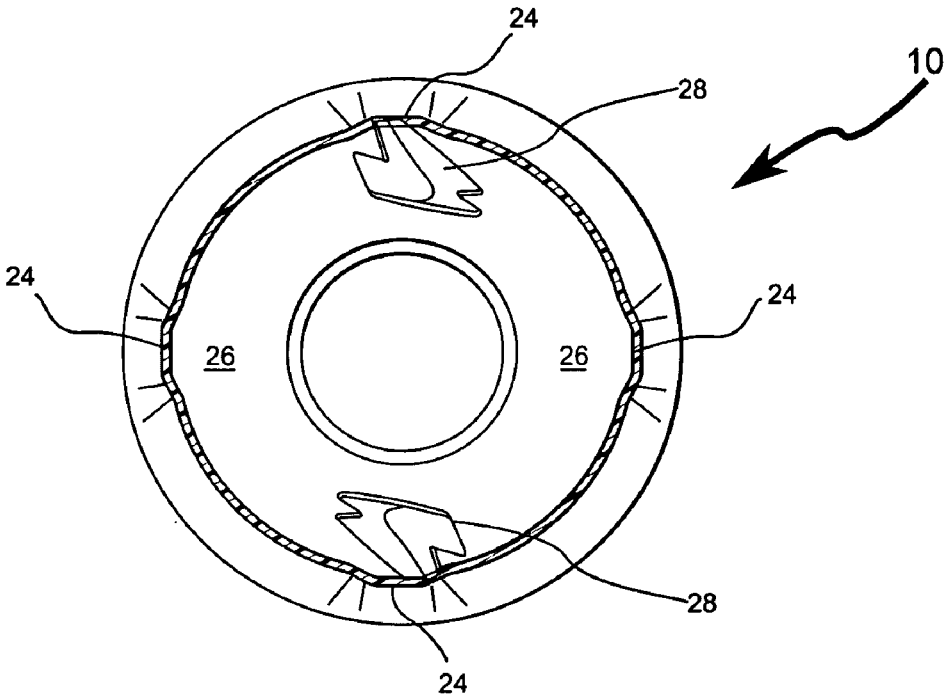
FIG. 6 is a cross sectional view along line 7-7 of FIG. 2.
Figure 7:
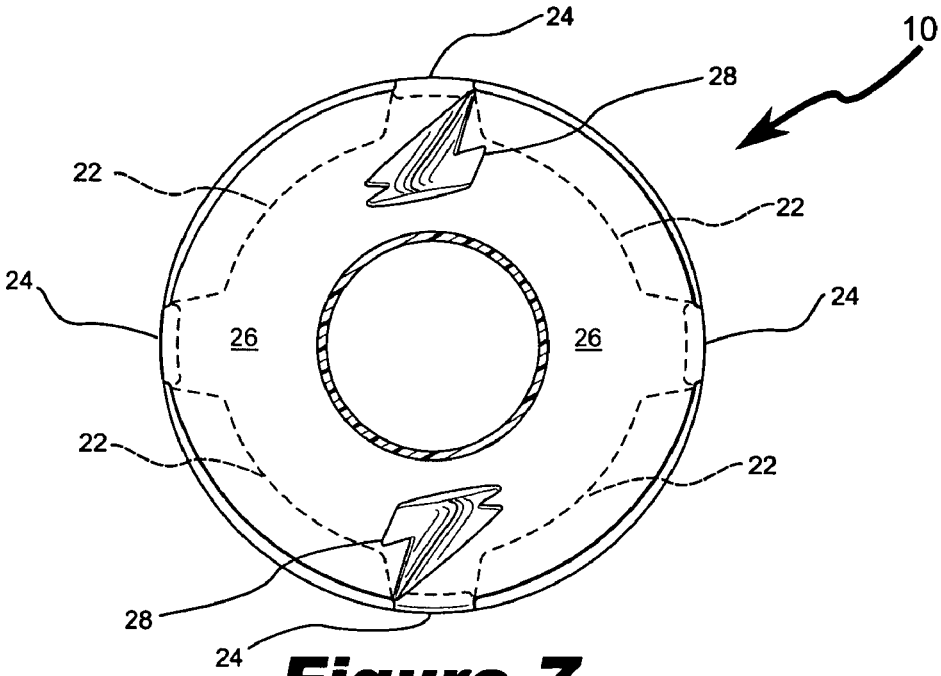
FIG. 7 is a cross sectional view along line 9-9 of FIG. 1.

Hydrostatic pressure absorption panels 22 function to absorb at least a substantial portion of the positive pressure inside container 10 in circumstances where container 10 is subjected to an external downwardly directed vertical force F that compresses container 10. Examples of such circumstances can include stacking packaged containers on top of each other during storage, transportation, or while on display at retail stores. The design in accordance with the invention allows the bottle to typically withstand about 80% greater downwardly directed force compared to a similar bottle without the hydrostatic pressure absorption panels and the circumferential ring. Surprisingly, it was discovered that the design in accordance with the invention allows the bottle to typically withstand about 200% greater downwardly directed force compared to a bottle having a similar mass, geometry, and volume, but without featuring the hydrostatic pressure absorption panels and the circumferential ring. As hydrostatic pressure absorption panels 22 absorb the resulting positive, internal pressure of container 10, the panels move in an outwardly direction preventing container 10 from bulging out, buckling, or both. Furthermore, after external downwardly directed vertical force F ceases to act on container 10, hydrostatic pressure absorption panels 22 return to their original position substantially restoring container 10 to its original shape and geometry. FIGS. 5 and 7 disclose four hydrostatic pressure absorption panels 22. However, a greater or fewer number of hydrostatic pressure absorption panels 22 can be used so long as the function is achieved. Typically, the number of hydrostatic pressure absorption panels 22 is from about 2 to about 10 panels, preferably from about 4 to about 8 panels. The term "hydrostatic pressure" as used herein refers to the positive pressure inside container 10 which may increase as container 10 is subjected to external downwardly directed vertical force F.

Ribs 24 are relatively rigid elements that provide structural support to container 10 and have a generally uniform width. In one embodiment of the present invention not shown in the figures, ribs 24 can be slightly concave with respect to dome section 16. In another embodiment of the present invention not shown in the figures, ribs 24 can be substantially flat.

As shown in FIGS. 2 through 4, circumferential ring 18 is typically located between dome section 16 and body section 14 and is generally curved inward in the shape of an arc. Circumferential ring 18 is an important element in hot-fill applications to substantially reduce distortions, such as ovalization, of the container. Those skilled in the art will appreciate that circumferential ring 18 may not be required in other filling process such as cold-filled applications that do not exhibit the container distortion problem typical of hot-fill applications.

In addition, circumferential ring 18 can be used to substantially offset the vertical deformation that results from the external downward vertical force acting on the container.

Finish 20 can be any suitable finish having an opening which can be adapted to receive a closing member.

Referring again to FIG. 2, container 10 has an overall length $H_C$ measured from the bottom of base 12 to the top of dome 16 exclusive of finish 20 and an overall diameter D measured across base 12. Container 10 typically has a $H_C$:D ratio from about 1.7:1 to about 2.1:1, preferably from about 1.8:1 to about 2.0:1. In one embodiment, length $H_C$ is typically from about 150 millimeters (mm) to about 210 mm, preferably from about 170 mm to about 190 mm. Diameter D is typically from about 90 mm to about 100 mm, preferably from about 94 mm to about 96 mm.

Dome section 16 has an overall length $H_D$ measured from the top of circumferential ring 18 to the top of dome section 16 exclusive of finish 20. Body section 14 has an overall length $H_B$ measured from the bottom of base 12 to the bottom of circumferential ring 18. The ratio $H_B$:$H_D$ is typically from about 0.6:1.0 to about 1.5:1.0, preferably from about 0.9:1.0 to about 1.1:1.0. In one embodiment, length $H_D$ is from about 63 mm to about 105 mm, preferably from about 75 mm to about 90 mm. Length $H_B$ is from about 63 mm to about 105 mm, preferably from about 75 mm to about 90 mm.

Circumferential ring 18 has a length $H_R$ measured from the top of body section 14 to the bottom of dome section 16. The ratio of $H_R$:$H_C$ is typically from about 1:7 to about 1:16, preferably from about 1:10 to about 1:13. In one embodiment, length $H_R$ is typically from about 13 mm to about 19 mm, preferably from about 15 mm to about 17 mm.

While some dimensions of an embodiment of the present invention have been disclosed, those skilled in the art will appreciate that the specific dimensions of the container can be varied to produce smaller or larger containers while preserving the ratios of the present invention.

The present invention further discloses a container made of plastic materials. Polyethylene terephthalate, or PET as is commonly known in the art, is a plastic material used commonly in the manufacture of food and beverage containers. Other suitable plastic materials that can be used in accordance with the present invention include, without limitation, polypropylene (PP), and other polymers known to those skilled in the art.

In accordance with another aspect of the present invention, a method of absorbing a downward vertical top-load is provided. The method comprises providing a plastic container as previously described and exerting an external downwardly directed vertical force on the container causing the hydrostatic pressure absorption panels to move outwardly to absorb at least a substantial portion of the positive, internal pressure in the container resulting from the application of the external downwardly directed vertical force.

While the invention has been described with respect to certain preferred embodiments, as will be appreciated by those skilled in the art, it is to be understood that the invention is capable of numerous changes, modifications and rearrangements and such changes, modifications and rearrangements are intended to be covered by the following claims. Specifically, FIGS. 1 through 8 are provided to illustrate embodiments of the present invention and not for the purpose of limiting the same.

The invention claimed is:

1. A plastic container comprising:

a base;

a body section attached to the base;

a dome section comprising a plurality of circumferentially spaced hydrostatic pressure absorption panels each located between vertically extending, circumferentially spaced ribs, wherein each of the hydrostatic pressure absorption panels is indented from the dome section and has a depth of indentation that increases from a bottom of the dome section toward a top of the dome section;

a circumferential ring located between a top of the body section and the bottom of the dome section; and said hydrostatic pressure absorption panels being adapted to absorb a substantial portion of a hydrostatic pressure exerted on the container resulting from external downwardly directed vertical forces acting on the container.

2. The container of claim 1 further comprising a finish attached to the dome section, the finish having an opening and adapted to receive a closing member.

3. The container of claim 1, wherein said body section comprises a plurality of circumferentially spaced vacuum flex panels.

4. The container of claim 1 wherein is adapted such that an external downward vertical force acting on the container creates a vertical deformation that is substantially offset by the circumferential ring.

5. The container of claim 4 wherein the container has an original shape and geometry prior to the external downward vertical force acting on it; and wherein the container is adapted such that when the container is relieved from the external downward vertical force and is substantially restored to its original shape and geometry.

6. The container of claim 1, wherein said dome section comprises from about 2 to about 10 circumferentially spaced hydrostatic pressure absorption panels each located between vertically extending, circumferentially spaced ribs.

7. The container of claim 6, wherein said dome section comprises from about 4 to about 6 circumferentially spaced hydrostatic pressure absorption panels each located between vertically extending, circumferentially spaced ribs.

8. The container of claim 1, wherein said container has:

a diameter D measured across the base; and a length $H_C$ measured from the bottom of the base of the container to the top of the dome section.

9. The container of claim 8 wherein D is from about 90 millimeters to about 100 millimeters.

10. The container of claim 8 wherein $H_C$ is from about 150 millimeters to about 210 millimeters.

11. The container of claim 8 wherein the ratio of $H_C$:D is from about 1.7:1.0 to about 2.1:1.0.

12. The container of claim 1 wherein the dome section has a length $H_D$ measured from the top of the circumferential ring to the top of the dome section and the body section has a length $H_B$ measured from the bottom of the base to the bottom of the circumferential ring.

13. The container of claim 12 wherein $H_D$ is from about 63 millimeters to about 107 millimeters.

14. The container of claim 12 wherein $H_B$ is from about 63 millimeters to about 107 millimeters.

15. The container of claim 12 wherein the ratio of $H_D$:$H_B$ is from about 0.6:1.0 to about 1.5:1.0.

16. The container of claim 1 wherein the circumferential ring has a length $H_R$ measured from the top of the body section to the bottom of the dome section.

17. The container of claim 16 wherein $H_R$ is from about 13 millimeters to about 19 millimeters.

18. A method of absorbing a downward vertical top-load comprising:

providing a container comprising a base, a body section attached to the base, a dome section comprising a plurality of circumferentially spaced hydrostatic pressure absorption panels each located between vertically extending, circumferentially spaced ribs, a circumferential ring located between the body section and the dome section, and a finish attached to the dome section and including a closure member, wherein the container has a fluid substance contained therein;

exerting an external downward vertical force on the container, resulting in a positive, internal hydrostatic pressure in the fluid substance in the container, wherein the hydrostatic pressure causes the hydrostatic pressure absorption panels to move outwardly to absorb at least a substantial portion of the hydrostatic pressure.

19. The method of claim 18 wherein the external downward vertical force creates a vertical deformation that is substantially offset by the circumferential ring.

20. The method of claim 19 wherein the container has an original shape and geometry prior to the external downward vertical force acting on it; and wherein the container is relieved from the external downward vertical force and is substantially restored to its original shape and geometry.

21. A plastic container comprising:

a base;

a body section attached to the base and extending upward from the base;

a circumferential ring attached to the body section and extending upward from the body section, the circumferential ring being indented inwardly;

a dome section comprising a plurality of circumferentially spaced hydrostatic pressure absorption panels and a plurality of vertically extending, circumferentially spaced ribs positioned between the hydrostatic pressure absorption panels; and a finish attached to a top of the dome section, the finish having an opening and adapted to receive a closing member, wherein each of the panels is inwardly indented with respect to the ribs, an upper area of the dome section located above the panel, and a lower area of the dome section located below the panel, wherein each of the panels comprises an upper indentation and a lower indentation, and each of the hydrostatic pressure absorption panels is bounded by an upper transition extending inwardly from the upper area of the dome section to the upper indentation, a lower transition extending inwardly from the lower area of the dome section to the lower indentation, and two side transitions, each extending inwardly from one of the ribs to opposed sides of the panels, and wherein the upper transition extends farther inwardly than the lower transition such that the upper indentation has a greater degree of inward indentation than the lower indentation.

22. The container of claim 21 wherein body section further comprises a plurality of circumferentially spaced vacuum panels.

* * * * *

UNITED STATES PATENT AND TRADEMARK OFFICE

CERTIFICATE OF CORRECTION

PATENT NO. : 7,661,548 B2
APPLICATION NO. : 11/338970
DATED : February 16, 2010
INVENTOR(S) : Dmitriy Shmagin It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1026 days.

Signed and Sealed this

Thirtieth Day of November, 2010

David J. Kappos

David J. Kappos
*Director of the United States Patent and Trademark Office*